United States Patent [19]

Kuroda et al.

[11] Patent Number: 4,612,137

[45] Date of Patent: Sep. 16, 1986

[54] ANTI-YELLOWING DETERGENT COMPOSITION CONTAINING CITRATE AND ISOCITRATE

[75] Inventors: Mutsumi Kuroda; Moriyasu Murata, both of Utsunomiya, Japan

[73] Assignee: Kao Corporation, Tokyo, Japan

[21] Appl. No.: 768,888

[22] Filed: Aug. 23, 1985

[30] Foreign Application Priority Data

Sep. 3, 1984 [JP] Japan ..... 59-183951

[51] Int. Cl.[4] ..... C11D 3/04; C11D 3/20; C11D 3/37; C11D 3/60

[52] U.S. Cl. ..... 252/174.19; 252/132; 252/135; 252/140; 252/174.21; 252/179; 252/180; 252/181; 252/142; 252/DIG. 11

[58] Field of Search ..... 252/132, 135, 140, 174.19, 252/174.21, 180, 181, 142

[56] References Cited

U.S. PATENT DOCUMENTS

| | | | |
|---|---|---|---|
| 2,806,001 | 9/1957 | Fong | 252/174.21 |
| 3,692,684 | 9/1972 | Hentschel | 252/174.19 |
| 3,749,675 | 7/1973 | Chang | 252/135 |
| 3,896,056 | 7/1975 | Benjamin | 252/539 |
| 3,945,951 | 3/1976 | Arai | 252/546 |
| 3,951,877 | 4/1976 | Okumura | 252/526 |
| 4,028,262 | 6/1977 | Cheng | 252/135 |
| 4,075,093 | 2/1978 | Walch | 210/23 H |
| 4,096,081 | 6/1978 | Phenicie | 252/140 |
| 4,231,890 | 11/1980 | Yagi | 252/186 |
| 4,548,757 | 10/1985 | Wevers | 260/502.5 |

FOREIGN PATENT DOCUMENTS

| | | |
|---|---|---|
| 1285687 | 8/1972 | United Kingdom . |
| 1438066 | 6/1976 | United Kingdom . |

*Primary Examiner*—Dennis L. Albrecht

*Attorney, Agent, or Firm*—Flynn, Thiel, Boutell & Tanis

[57] ABSTRACT

A detergent composition containing citric acid or its salt and isocitric acid or its salt as builders is provided. This composition has a remarkable effect of inhibiting yellowing of clothes caused by iron components contained in washing water.

8 Claims, No Drawings

ANTI-YELLOWING DETERGENT COMPOSITION CONTAINING CITRATE AND ISOCITRATE

BACKGROUND OF THE INVENTION

1. Field of the Invention

The present invention relates to a detergent composition having an excellent effect of keeping clothes from yellowing. More particularly, the invention relates to a detergent composition containing citric acid or its salt and isocitric acid or its salt and having an excellent effect of keeping clothes from yellowing by iron components contained in the washing water.

2. Prior Art

Recently, the use of polyphosphates which have been used as main builder for detergents for clothes has been reduced sharply for fear of eutrophication of a closed water system caused by them, and instead phosphate-free detergents are now mainly used. Although water-insoluble zeolite is mainly used as builder for the phosphate-free detergents, its building effect is yet unsatisfactory and, in addition, the zeolite poses problems during the production and use thereof because it is insoluble in water. Under these circumstances, intensive investigations are now being made for the purpose of finding builders other than the above-mentioned zeolite for the phosphate-free detergents.

The properties required of the builders include a capacity of softening hard water, buffer capacity, dispersing capacity, biodegradability and safety and, in addition, a low cost is also required. The builders now attracting attention are citrates in addition to NTA (nitrilotriacetates) etc. The citrates are capable of complexing calcium and magnesium ions and have satisfactory biodegradability and safety.

However, a detergent containing a citrate as a main builder has a defect that it causes yellowing of clothes due to iron contained in the washing water to an extent higher than that caused when a detergent containing an ordinary builder is used. According to investigations now under way on the yellowing of clothes due to ions contained in the washing water, the iron content of tap water used in the washing of clothes seems to be on a relatively high level in homes having their own water reservoirs which are now increasing in number as the apartment houses and tall dwelling buildings are increasing. When such tap water is repeatedly used in washing, clothes are gradually yellowed by the effect of iron [see J. Jap. Res. Assoc. Text. End-uses, 17 (8), 294–300 (1976)].

SUMMARY OF THE INVENTION

After intensive investigations made for the purpose of improving a yellowing inhibiting effect of citrate-containing detergents, the inventors have found that when an isocitrate is used together with a citrate, said effect can be improved. The present invention has been completed on the basis of this finding.

DETAILED DESCRIPTION OF PREFERRED EMBODIMENTS

The detergent composition of the present invention contains (a) citric acid or its salt and (b) isocitric acid or its salt as the builders. The total amount of the components (a) and (b) is 0.1 to 50 wt. %, particularly preferably 1 to 30 wt. %, based on the composition. The weight ratio of the component (a) to the component (b) is preferably in the range of 99.5:0.5 to 40:60. When the amount of the component (b) exceeds said range, the capacity of the detergent of combining with calcium is reduced. The component (a) is preferably sodium citrate and the component (b) is preferably sodium isocitrate.

It has been found also that when polyethylene glycol having an average molecular weight of 1,000 to 20,000 is incorporated in the detergent composition of the present invention is addition to the components (a) and (b), the effect of inhibiting the yellowing is further improved remarkably and the antiredeposition effect of the detergent is also improved. The amount of the polyethylene glycol is 0.1 to 5 wt. %, preferably 1 to 3 wt. %.

It was also confirmed that the detergent of the present invention had an essential deterging capacity which was not inferior to that of the conventional detergents. As a result, the inventors have completed a detergent composition having both a sufficient deterging capacity and an excellent effect of inhibiting the yellowing of clothes.

Citric acid or its salt used in the present invention may be produced by any ordinary process. Thus, citric acid or its salt can be produced by a fermentation process with microorganisms of, for example, the genus Aspergillus or a process wherein citric acid is obtained from citrus fruits such as oranges and tangerines and, if necessary, it is neutralized to form its salt. Isocitric acid or its salt can be produced similarly by a fermentation process with microorganisms of, for example, the genus Candida.

The detergent of the present invention may be used in any desired form such as granules, powder, liquid or solid.

The detergent composition of the present invention may further contain additives such as surfactants; builders other than those used as the indispensable components of the present invention; sequestering agents; bulking agents such as Glauber's salt; alkalis; inorganic electrolytes; antiredeposition agents such as polyvinylpyrrolidone and carboxymethylcellulose; enzymes such as proteases, esterases and carbohydrases and nucleases; caking inhibitors such as p-toluenesulfonates, sulfosuccinates, talc and calcium silicate; bleaching agents such as sodium percarbonate and sodium perborate mono- or tetrahydrate; bleaching activators such as triacetyl cyanurate and sodium p-acetoxybenzenesulfonate; stabilizers for peroxides such as magnesium silicate and magnesium sulfate; antioxidants such as tert-butylhydroxytoluene and distyrenated cresol; fluoroscent dyes; blueing agents; and perfumes. These additives are not particularly limited and they may be selected depending on the purpose.

[1] Surfactants

Examples of anionic surfactants include straight-chain or branched alkylbenzenesulfonates, alkyl or alkenyl ether sulfates, alkyl or alkenyl sulfates, olefinsulfonates, alkanesulfonates, saturated or unsaturated fatty acid salts, alkyl or alkenyl ether carboxylates, $\alpha$-sulfo fatty acid salts or esters, amino acid surfactants, N-acylamino acid surfactants, alkyl or alkenyl hydrogen phosphates and alkyl or alkenyl phosphates or their salts.

Examples of amphoteric surfactants include carboxy or sulfobetaine surfactants.

Examples of nonionic surfactants include polyoxyalkylene alkyl or alkenyl ethers, polyoxyethylene alkylphenyl ethers, higher fatty acid alkanolamides or their alkylene oxide adducts, sucrose fatty acid esters, fatty acid glycerol monoesters and alkylamine oxides.

Examples of cationic surfactants include quaternary ammonium salts.

It is preferred that the composition contains 10 to 40 wt. % of at least one surfactant.

[2] Divalent Metal Ion-sequesterng Agents

The composition may contain up to 50 wt. % of one or more builder components selected from the group consisting of the following alkali metal salts and alkanolamine salts (provided that when phosphorous-containing builders are used, the amount of then is up to 10 wt. % in terms of $P_2O_5$):

phosphates such as tripolyphosphates and pyrophosphates; phosphonates such as ethane-1,1-diphosphonates; phosphonocarboxylates such as 2-phosphonobutane-1,2-dicarboxylates; amino acid salts such as aspartic and glutamic acid salts; aminopolyacetates such as nitrilotriacetates and ethylenediaminetetraacetates; high molecular electrolytes such as polyacrylic acid and polyaconitic acid; non-dissociating polymers such as polyvinyl alcohol and polyvinylpyrrolidone; salts of organic acids such as diglycolic acid and hydroxycarboxylic acids; and aluminosilicates.

[3] Alkalis and inorganic electrolytes

The composition may contain 1 to 50 wt. %, preferably 5 to 30 wt. %, of one or more alkali metal salts selected from the group consisting of the following compounds as the alkalis or inorganic electrolytes:

alkali metal silicates, carbonates, sulfates, mono-, di- or triethanolamines and triisopropanolamines.

The following examples will further illustrate the present invention, which by no means limit the invention.

EXAMPLE 1

The effects of the following detergent compositions in inhibiting the yellowing of test cloths were examined to obtain the results shown in Table 1.

Test Cloths 10 cm×10 cm cotton cloths for underwears which had been washed according to the specification of JIS detergent test repeatedly three times; 5 pieces/;

Conditions turgotometer, 100 rpm
washing time: 10 min
dehydration: 1 min
rinsing: 3 min
detergent concentration 0.133%
temperature: 20° C.
quality of washing water and rinsing water: 4°DH, $Fe^{+++}$ 0.5 ppm ($FeCl_3$ used)
drying method: air drying Procedure cumulative number of times of washing: 2 (washing→dehydration→rinsing→dehydration→rinsing→dehydration→washing→dehydration→rinsing→dehydration→rinsing→dehydration→air drying)

In this example, $FeCl_3$ was added as the iron component to the washing water for the purpose of accelerating the yellowing of test cloth so as to examine the effect of the detergent in inhibiting the yellowing due to the iron component.

The five detergents of the above-mentioned compositions were subjected to the deterging tests under the above-mentioned conditions and the effects of inhibition of yellowing due to the iron component were examined by the following method:

The reflectivity of the test cloths before and after the washing was determined with a light of a wavelength of 460 mμ and the rate of inhibition of yellowing due to the iron component was determined according to the following formula:

$$\text{Rate of inhibition of yellowing (\%)} = \frac{R_{(s)}}{R_{(o)}} \times 100$$

wherein $R_{(o)}$ represents a reflectivity of the original test cloth and $R_{(s)}$ represents a reflectivity of the test cloth after the washing.

| Formulation | Detergent composition (wt. % based on the composition) A (Comp. Ex. 1) | B (Comp. Ex. 2) | C (Comp. Ex. 3) | D (Present invention) | E (Present invention) |
|---|---|---|---|---|---|
| Sodium straight-chain alkylbenzenesulfonate ($C_{12}$) | 15 | 15 | 15 | 15 | 15 |
| Sodium higher alcohol sulfate ($C_{12\ to\ 14}$) | 5 | 5 | 5 | 5 | 5 |
| Sodium tripolyphosphate* | 20 | — | — | — | — |
| Synthetic zeolite 4A* | — | 20 | — | — | — |
| Sodium citrate* | — | — | 20 | 16 | 10 |
| Sodium isocitrate* | — | — | — | 4 | 10 |
| Sodium silicate (JIS No. 2) | 10 | 10 | 10 | 10 | 10 |
| Soidum carbonate | 5 | 5 | 5 | 5 | 5 |
| Fluorescent dye | 0.5 | 0.5 | 0.5 | 0.5 | 0.5 |
| Sodium carboxymethylcellulose | 0.5 | 0.5 | 0.5 | 0.5 | 0.5 |
| Water | 5 | 5 | 5 | 5 | 5 |
| Sodium sulfate | balance | balance | balance | balance | balance |

*Reagents produced by Wako Jun'yaku Co., Ltd.

TABLE 1

| | | A (Comp. Ex. 1) | B (Comp. Ex. 2) | C (Comp. Ex. 3) | D (Present invention) | E (Present invention) |
|---|---|---|---|---|---|---|
| Builders used | Sodium tripolyphosphate | 20 | — | — | — | — |
| | Zeolite 4A | — | 20 | — | — | — |

TABLE 1-continued

| | | A (Comp. Ex. 1) | B (Comp. Ex. 2) | C (Comp. Ex. 3) | D (Present invention) | E (Present invention) |
|---|---|---|---|---|---|---|
| (%) | Sodium citrate | — | — | 20 | 16 | 10 |
| | Sodium isocitrate | — | — | — | 4 | 10 |
| Rate of inhibition of yellowing (%) | | 65.3 | 60.3 | 55.0 | 63.8 | 64.2 |

It is apparent from the results shown in Table 1 that when sodium citrate was used alone as the builder, (Composition C), the effect of inhibition of yellowing due to iron was inferior to those of compositions A and B wherein sodium tripolyphosphate and zeolite 4A, respectively, were used as the builder. The compositions D and E of the present invention had the effect of inhibition of the yellowing which was improved to an extent almost comparable to that of the phosphate detergent of Composition A.

EXAMPLE 2

The effects of liquid detergents having the compositions shown below in inhibiting the yellowing of test cloths were examined in the same manner as in Example 1 to obtain the results shown in Table 2.

| Formulation | Detergent composition (wt. % based on the composition) A (Comp. Ex. 1) | B (Comp. Ex. 2) | C (Present invention) | D (Present invention) |
|---|---|---|---|---|
| Alkyl ether sulfate (EO $\overline{P}$ = 3.5) | 30 | 30 | 30 | 30 |
| Nonylphenol polyoxyethylene ether (EO $\overline{P}$ = 9) | 10 | 10 | 10 | 10 |
| Ethanol | 5 | 5 | 5 | 5 |
| Sodium carboxymethylcellulose | 1 | 1 | 1 | 1 |
| Fluorescent dye | 0.3 | 0.3 | 0.3 | 0.3 |
| Potassium pyrophosphate* | 5 | — | — | — |
| Sodium citrate* | — | 5 | 4 | 2.5 |
| Sodium isocitrate* | — | — | 1 | 2.5 |
| Perfume | 0.1 | 0.1 | 0.1 | 0.1 |
| Enzyme | 0.5 | 0.5 | 0.5 | 0.5 |
| Water | balance | balance | balance | balance |

*Reagents produced by Wako Jun'yaku Co., Ltd.

The detergent concentration was 0.1% and the other conditions were the same as those in Example 1.

TABLE 2

| | | A (Comp. Ex. 1) | B (Comp. Ex. 2) | C (Present invention) | D (Present invention) |
|---|---|---|---|---|---|
| Build-ers used (%) | Potassium pyrophosphate | 5 | — | — | — |
| | Sodium citrate | — | 5 | 4 | 2.5 |
| | Sodium isocitrate | — | — | 1 | 2.5 |
| Rate of inhibition of yellowing (%) | | 55.4 | 49.9 | 52.9 | 53.9 |

It is apparent from Table 2 that the detergent composition of the present invention may be in the form of also a liquid (paste). The compositions C and D according to the present invention had the effect of inhibiting the yellowing due to iron which was superior to that of the comparative composition B and nearly equal to that of the comparative composition A.

EXAMPLE 3

Western-type detergents of the following compositions were subjected to the same test as in Examples 1 and 2 to examine their effects of inhibition of the yellowing of the test cloths. The results are shown in Table 3.

| Formulation | Western-type detergent composition (wt. % based on the composition) A (Comp. Ex. 1) | B (Comp. Ex. 2) | C (Comp. Ex. 3) | D (Present invention) | E (Present invention) |
|---|---|---|---|---|---|
| Sodium straight-chain alkylbenzenesulfonate | 5 | 5 | 5 | 5 | 5 |
| Beef tallow alcohol/EO (15 mol) adduct | 3 | 3 | 3 | 3 | 3 |
| Soap | 3 | 3 | 3 | 3 | 3 |
| Sodium tripolyphosphate* | 24 | 12 | 12 | 12 | 12 |
| Zeolite 4A* | — | 12 | — | — | — |
| Sodium citrate* | — | — | 12 | 10 | 6 |
| Sodium isocitrate* | — | — | — | 2 | 6 |
| Sodium silicate (JIS No. 2) | 10 | 10 | 10 | 10 | 10 |
| Sodium carbonate | 3 | 3 | 3 | 3 | 3 |
| Enzyme | 0.5 | 0.5 | 0.5 | 0.5 | 0.5 |
| Sodium carboxymethylcellulose | 1 | 1 | 1 | 1 | 1 |
| Fluorescent dye | 0.5 | 0.5 | 0.5 | 0.5 | 0.5 |
| Sodium perborate tetrahydrate | 15 | 15 | 15 | 15 | 15 |
| Water | 8 | 8 | 8 | 8 | 8 |

-continued

| Formulation | Western-type detergent composition (wt. % based on the composition) A (Comp. Ex. 1) | B (Comp. Ex. 2) | C (Comp. Ex. 3) | D (Present invention) | E (Present invention) |
|---|---|---|---|---|---|
| Glauber's salt | balance | balance | balance | balance | balance |

*Reagents produced by Wako Jun'yaku Co., Ltd.

Test Cloths

The same cloths as in Example 1 but which were sewed on a base cloth.

Conditions

Commercial drum-type washing machine.
washing time: 30 min
detergent concentration: 0.75%
washing temperature: 90° C.
bath ratio: $\frac{1}{8}$ (controlled with the cotton underwear)
quality of washing water and rinsing water: 20°DH, $Fe^{+++}$ 0.5 ppm ($FeCl_3$ used)
cumulative number of times of washing: 2
air drying
The other conditions were the same as in Examples 1 and 2.

TABLE 3

| | | A (Comp. Ex. 1) | B (Comp. Ex. 2) | C (Comp. Ex. 3) | D (Present invention) | E (Present invention) |
|---|---|---|---|---|---|---|
| Builders used (%) | Sodium tripolyphosphate | 24 | 12 | 12 | 12 | 12 |
| | Zeolite 4A | — | 12 | — | — | — |
| | Sodium citrate | — | — | 12 | 10 | 6 |
| | Sodium isocitrate | — | — | — | 2 | 6 |
| Rate of inhibition of yellowing (%) | | 72.1 | 66.6 | 65.9 | 66.7 | 70.1 |

It is apparent from Table 3 that also in the Western-type detergent compositions as in this example, the effects of the compositions D and E of the present invention in inhibiting the yellowing due to iron were superior to that of the comparative composition C and nearly equal to that of the comparative compositions A and B.

EXAMPLE 4

Test clothes were washed with the following detergent compositions repeatedly 100 times cumulatively. The whiteness of the cotton underwears was measured by means of a colorimeter and the amount of adhering iron was measured according to an atomic absorption spectroscopy. The results are shown in Table 4.

| | Detergent composition A (Comp. Ex. 1) | B (Comp. Ex. 2) | C (Comp. Ex. 3) | D (Present invention) | E (Present invention) |
|---|---|---|---|---|---|
| Sodium straight-chain alkylbenzenesulfonate | 10 | 10 | 10 | 10 | 10 |
| Sodium α-olefinsulfonate | 5 | 5 | 5 | 5 | 5 |
| Alkyl ether sulfate (EO P = 1) | 3 | 3 | 3 | 3 | 3 |
| Sodium tripolyphosphate* | 20 | — | — | — | — |
| Synthetic zeolite 4A* | — | 20 | — | — | — |
| Sodium citrate* | — | — | 20 | 16 | 10 |
| Sodium isocitrate* | — | — | — | 4 | 10 |
| Sodium silicate (JIS No. 1) | 8 | 8 | 8 | 8 | 8 |
| Sodium carbonate | 6 | 6 | 6 | 6 | 6 |
| Fluorescent dye | 0.5 | 0.5 | 0.5 | 0.5 | 0.5 |
| Sodium carboxymethylcellulose | 1 | 1 | 1 | 1 | 1 |
| Enzyme | 0.5 | 0.5 | 0.5 | 0.5 | 0.5 |
| Sodium percarbonate | 7 | 7 | 7 | 7 | 7 |
| Water | 5 | 5 | 5 | 5 | 5 |
| Sodium sulfate | balance | balance | balance | balance | balance |

*Reagents produced by Wako Jun'yaku Co., Ltd.

Test Cloths

Commercially available underwears of pure cotton which had been washed with a JIS detergent repeatedly three times and dried.

Washing Conditions commercial two-tank washing machine (30 l).
amount of detergent used: 40 g
washing time: 10 min (strong reverse turn)
washing temperature: 20° C.
bath ratio: 1/30
rinsing with non-running water: twice
air drying
quality of water: tap waster (Sumida-ku, Tokyo, Fe: content: 0.1 to 0.2 ppm)

Colorimetry digital color difference meter ND-1001 DP (a product of Nihon Denshoku Co.) (light source: a halogen lamp).

The measurement was conducted at three portions in the back portion of each shirt.

Atomic Absorption Spectroscopy

A part (1 g) of each cotton underwear was sampled. The sample was completely incinerated and then dissolved in 20 cc of 2N-HCl. After diluted to a volume of 50 cc in a volumetric flask, the Fe content of the solution was determined with an atomic absorption spectrometer (calibration-curve flameless process). The values in the table refer to the amounts of Fe contained in 1 g of the cotton cloth.

TABLE 4

| Builders used | | A (Comp. Ex. 1) | B (Comp. Ex. 2) | C (Comp. Ex. 3) | D (Present invention) | E (Present invention) |
|---|---|---|---|---|---|---|
| Sodium tripolyphosphate | | 20 | — | — | — | — |
| Synthetic zeolite 4A | | — | 20 | — | — | — |
| Sodium citrate | | — | — | 20 | 18 | 10 |
| Sodium isocitrate | | — | — | — | 2 | 10 |
| After washing repeatedly 50 times | Colorimetric value* (b value) | −7.45 | −7.01 | −6.52 | −7.10 | −7.39 |
| | Fe content (ppm) | 10.2 | 13.3 | 16.0 | 12.2 | 10.7 |
| After washing repeatedly 100 times | Colorimetric value* (b value) | −7.05 | −6.48 | −6.31 | −6.77 | −6.99 |
| | Fe content (ppm) | 11.9 | 20.1 | 20.3 | 15.2 | 12.2 |

*The higher the b value, the higher the degree of yellowness. This value is correlated well with the amount of adhering iron [J. Jap. Res. Assoc. Text. End-uses, 17(8), 298 (1976)].
The value of the original cloth before washing:
b value: −7.50
Fe: 5.8 ppm It is apparent from Table 4 that the effects of the compositions D and E of the present invention in inhibiting the yellowing due to iron were more excellent than those of the comparative compositions B and C and nearly equal to that of the comparative composition A. In this example, the cumulative washing tests were conducted under substantially practical washing conditions using tap water. An excellent effect of the detergent compositions of the present invention in inhibiting the yellowing was observed also under such conditions.

EXAMPLE 5

The effects of the following detergent compositions in inhibiting the yellowing of clothes and antiredeposition effects thereof against carbon black and clay were examined to obtain the results shown in Table 5.

| | Detergent composition | | | | | | | | |
|---|---|---|---|---|---|---|---|---|---|
| | A (Comp. Ex.) | B (Comp. Ex.) | C (Comp. Ex.) | D (Comp. Ex.) | E (Comp. Ex.) | F (Comp. Ex.) | G (Present invention) | H (Present invention) | I (Present invention) |
| Sodium straight-chain alkylbenzenesulfonate | 16 | 16 | 16 | 16 | 16 | 16 | 16 | 16 | 16 |
| Methyl ester of α-Sulfo fatty acid | 6 | 6 | 6 | 6 | 6 | 6 | 6 | 6 | 6 |
| Soap | 0.8 | 0.8 | 0.8 | 0.8 | 0.8 | 0.8 | 0.8 | 0.8 | 0.8 |
| Sodium tripolyphosphate | 20 | — | — | — | — | — | — | — | — |
| Synthetic zeolite 4A | — | 20 | — | — | — | — | — | — | — |
| Sodium citrate | — | — | 20 | 20 | 20 | 20 | 19 | 19 | 19 |
| Sodium isocitrate | — | — | — | — | — | — | 1 | 1 | 1 |
| Sodium silicate (JIS No. 3) | 10 | 10 | 10 | 10 | 10 | 10 | 10 | 10 | 10 |
| Sodium carbonate | 5 | 5 | 5 | 5 | 5 | 5 | 5 | 5 | 5 |
| Fluorescent dye | 0.5 | 0.5 | 0.5 | 0.5 | 0.5 | 0.5 | 0.5 | 0.5 | 0.5 |
| Sodium carboxymethylcellulose | 1 | 1 | 1 | 1 | 1 | 1 | 1 | 1 | 1 |
| Enzyme | 0.5 | 0.5 | 0.5 | 0.5 | 0.5 | 0.5 | 0.5 | 0.5 | 0.5 |
| Water | 5 | 5 | 5 | 5 | 5 | 5 | 5 | 5 | 5 |
| Polyethylene glycol (MW: 2000) | — | — | — | 1 | — | — | 1 | — | — |
| Polyethylene glycol (MW: 6000) | — | — | — | — | 1 | — | — | 1 | — |
| Polyethylene glycol (MW: 18000) | — | — | — | — | — | 1 | — | — | 1 |
| Sodium sulfate | balance | balance | balance | balance | balance | balance | balance | balance | balance |

Test 1: The effect of inhibition of yellowing of clothes was examined in the same manner as in Example 1.

Test 2: The antiredeposition effect was examined under the following conditions:

Test Cloths cotton broadcloth, nylon tricot, polyester Georgette and polyester/cotton blended fiber (65/35)
three pieces each (10 cm×10 cm)

Stains 0.25 g/l of carbon black and 2.5 g/l of clay

Conditions temperature: 20° C.
hardness: 4°DH
concentration: 0.133%
turgotometer: 100 r.p.m.
staining time: 10 min
bath ratio: 12 pieces of the test cloth per liter
rinsing with running water

Preparation of Staining Liquid

A staining component (0.25 g of carbon black or 2.5 g of clay) was put in 1 l of the washing water and the mixture was stirred thoroughly and immediately thereafter, it was treated in an ultrasonic dispersing device to obtain a homogeneous dispersion. The test pieces were stained with this dispersion immediately thereafter in a turgotometer.

Drying pressing at 130° C. for 30 sec

Examination

The reflectivities of the four kinds of the fibers were measured before and after the staining.

$$\text{Antiredeposition rate (\%)} = \frac{R_{(s)}}{R_{(o)}} \times 100$$

wherein $R_{(o)}$ represents a reflectivity of the original cloth and $R_{(s)}$ represents that of the stained cloth.

TABLE 5

| Builders used | | | A (Comp. Ex.) | B (Comp. Ex.) | C (Comp. Ex.) | D (Comp. Ex.) | E (Comp. Ex.) | F (Comp. Ex.) | G (Present invention) | H (Present invention) | I (Present invention) |
|---|---|---|---|---|---|---|---|---|---|---|---|
| Sodium tripolyphosphate | | | 20 | — | — | — | — | — | — | — | — |
| Synthetic zeolite 4A | | | — | 20 | — | — | — | — | — | — | — |
| Sodium citrate | | | — | — | 20 | 20 | 20 | 20 | 19 | 19 | 19 |
| Sodium isocitrate | | | — | — | — | — | — | — | 1 | 1 | 1 |
| Polyethylene glycol ($\overline{MW}$ = 2000) | | | — | — | — | 1 | — | — | 1 | — | — |
| Polyethylene glycol ($\overline{MW}$ = 6000) | | | — | — | — | — | 1 | — | — | 1 | — |
| Polyethylene glycol ($\overline{MW}$ = 18000) | | | — | — | — | — | — | 1 | — | — | 1 |
| Yellowing inhibition rate (%) | | | 66.8 | 61.2 | 51.3 | 51.1 | 59.3 | 52.7 | 63.8 | 64.0 | 64.0 |
| Antire-deposition rate (%) | Stained with carbon black | Cotton broadcloth | 83.3 | 85.4 | 85.0 | 86.6 | 86.2 | 87.0 | 88.8 | 88.8 | 87.0 |
| | | Nylon tricot | 90.3 | 90.0 | 90.2 | 89.8 | 91.0 | 90.5 | 90.2 | 90.0 | 90.1 |
| | | Polyester Georgette | 84.0 | 83.9 | 84.4 | 84.1 | 84.5 | 84.8 | 84.5 | 84.6 | 84.8 |
| | | Polyester/cotton blended fiber | 81.1 | 81.8 | 82.0 | 82.2 | 82.7 | 82.2 | 84.8 | 84.8 | 84.9 |
| | Stained with clay | Cotton broadcloth | 95.9 | 94.9 | 94.0 | 93.3 | 93.9 | 92.9 | 95.0 | 94.9 | 95.0 |
| | | Nylon tricot | 98.0 | 97.7 | 97.0 | 97.7 | 97.6 | 97.9 | 97.0 | 97.3 | 97.4 |
| | | Polyester Georgette | 97.0 | 90.8 | 90.0 | 91.1 | 90.8 | 91.5 | 93.2 | 92.9 | 93.4 |
| | | Polyester/cotton blended fiber | 95.0 | 94.8 | 94.2 | 95.6 | 95.6 | 95.1 | 95.0 | 95.7 | 95.3 |

It is apparent from Table 5 that the yellowing inhibition effects of the compositions G to I of the present invention were more excellent than those of the comparative compositions B to F and nearly equal to that of the comparative composition A. With respect to the antiredeposition effect against carbon black or clay, the compositions G to I of the present invention had a more excellent effect of inhibiting the redeposition of carbon black on cotton and polyester/cotton blended fiber and that of clay on cotton and polyester than those of the comparative compositions.

EXAMPLE 6

The deterging powers of the following detergent compositions were examined to obtain the results shown in Table 6.

| | Detergent composition | | | | | |
|---|---|---|---|---|---|---|
| | A (Comp. Ex.) | B (Comp. Ex.) | C (Comp. Ex.) | D (Present invention) | E (Present invention) | F (Present invention) |
| Sodium straight-chain alkylbenzenesulfonate | 15 | 15 | 15 | 15 | 15 | 15 |
| Sodium higher alcohol sulfate | 5 | 5 | 5 | 5 | 5 | 5 |
| Soap | 1 | 1 | 1 | 1 | 1 | 1 |
| Sodium tripolyphosphate | 20 | — | — | — | — | — |
| Synthetic zeolite 4A | — | 20 | — | — | — | — |
| Sodium citrate | — | — | 20 | 19 | 15 | 10 |
| Sodium isocitrate | — | — | — | 1 | 5 | 10 |
| Sodium silicate (JIS No. 3) | 4 | 4 | 4 | 4 | 4 | 4 |
| Sodium carbonate | 8 | 8 | 8 | 8 | 8 | 8 |
| Borax | 2 | 2 | 2 | 2 | 2 | 2 |
| Fluorescent dye | 0.5 | 0.5 | 0.5 | 0.5 | 0.5 | 0.5 |
| Polyethylene glycol ($\overline{MW}$ = 6000) | 1.5 | 1.5 | 1.5 | 1.5 | 1.5 | 1.5 |
| Enzyme | 1 | 1 | 1 | 1 | 1 | 1 |
| Water | 6 | 6 | 6 | 6 | 6 | 6 |
| Sodium sulfate | balance | balance | balance | balance | balance | balance |

Preparation of Naturally Stained Cloth

A piece of cotton/Tetoron blended fiber was sewed on a neck of a shirt. After a male adult wore the shirt for two days, the cloths on which a stain spread symmetrically about the central point thereof were selected and taken. The cloths were halved at the center of symmetry and subjected to the tests.

Estimation of Deterging Power

One of the halves of the naturally stained cloth prepared as above and halved symmetrically was washed with a detergent to be tested and the other half was washed with a standard detergent. A pair of the samples were evaluated by a pair-comparison process. The degrees of staining were ranked in 10 stages based on the standard stain. The deterging power of the sample was represented by a mark as compared with that of the standard detergent represented as 100. An average of 10 pieces was shown in Table 1. In the experiment in this example, the deterging power of the comparative phosphate-containing detergent A was employed as the standard (100).

Conditions

Commercial two-tank washing machine of strong reverse turn type.
tap water: 30 l
temperature: 20° C.
time: 10 min
rinsing time: 5 min with tap water (overflow rinsing)
bath ratio: 1/30 (400 g of shirt + 600 g of underwears + base cloth)

TABLE 6

| | A (Comp. Ex.) | B (Comp. Ex.) | C (Comp. Ex.) | D (Present invention) | E (Present invention) | F (Present invention) |
|---|---|---|---|---|---|---|
| Sodium tripolyphosphate | 20 | — | — | — | — | — |
| Synthetic zeolite 4A | — | 20 | — | — | — | — |
| Sodium citrate | — | — | 20 | 19 | 15 | 10 |
| Sodium isocitrate | — | — | — | 1 | 5 | 10 |
| Deterging power | 100 (standard) | 89 | 92 | 92 | 93 | 90 |

The fundamental washing power of the detergent compositions of the present invention were confirmed by this example. An excellent effect of the detergent composition of the present invention in inhibiting the yellowing of clothes were shown in Examples 1 to 5 given above. It is apparent from Table 6 that the deterging powers of the detergent compositions D to F of the present invention are not inferior to that of the comparative composition C containing sodium citrate alone as the builder and they were superior to that of the comparative composition B containing synthetic zeolite 4A as the builder.

What is claimed is:

1. A detergent composition, comprising:
from 1 to 50 percent by weight of (a) citric acid or salt thereof, and (b) isocitric acid or salt thereof, wherein the weight ratio of (a) to (b) is from 90:10 to 40:60; and
from 10 to 40 percent by weight of surfactant.

2. A detergent composition as claimed in claim 1, in which (a) is sodium citrate and (b) is sodium isocitrate.

3. A detergent composition as claimed in claim 1, in which the total amount of (a) plus (b) is 1 to 30 percent by weight.

4. A detergent composition as claimed in claim 1, containing up to 50 percent by weight of one or more detergent divalent metal ion-sequestering agents selected from the group consisting of phosphates, phosphonates, phosphonocarboxylates, amino acid salts, aminopolyacetates, polyacrylic acid, polyaconitic acid, polyvinyl alcohol, polyvinylpyrrolidone, salts of diglycolic acid and aluminosilicate zeolites, and containing from 1 to 50 percent by weight of one or more compounds selected from the group consisting of alkali metal silicates, alkali metal carbonates, alkali metal sulfates, monoethanolamine, diethanolamine, triethanolamine and triisopropanolamine.

5. A detergent composition, comprising:
from 1 to 50 percent by weight of a mixture of (a) citric acid or salt thereof, and (b) isocitric acid or salt thereof, wherein the weight ratio of (a) to (b) is from 19:1 to 40:60;
from 0.1 to 5 percent by weight of polyethylene glycol having an average molecular weight of 1000 to 20000; and
from 10 to 40 percent by weight of surfactant.

6. A detergent composition as claimed in claim 5, in which (a) is sodium citrate and (b) is sodium isocitrate.

7. A detergent composition as claimed in claim 5, in which the total amount of (a) plus (b) is 1 to 30 percent by weight and the amount of polyethylene glycol is from 1 to 3 percent by weight.

8. A detergent composition as claimed in claim 5, containing up to 50 percent by weight of one or more detergent divalent metal ion-sequestering agents selected from the group consisting of phosphates, phosphonates, phosphonocarboxylates, amino acid salts, aminopolyacetates, polyacrylic acid, polyaconitic acid, polyvinyl alcohol, polyvinylpyrrolidone, salts of diglycolic acid and aluminosilicate zeolites, and containing from 1 to 50 percent by weight of one or more compounds selected from the group consisting of alkali metal silicates, alkali metal carbonates, alkali metal sulfates, monolthanolamine, diethanolamine, triethanolamine and triisopropanolamine.

* * * * *